US005755450A

United States Patent [19]

Ellis et al.

[11] Patent Number: 5,755,450

[45] Date of Patent: May 26, 1998

[54] BRAKING SYSTEM FOR AN IN-LINE SKATE

[75] Inventors: Todd D. Ellis, Boston; David J. Lacorazza, Norwell, both of Mass.; Daniel A. Nolan, Salem; Lennart B. Johnson, Milford, both of N.H.

[73] Assignees: Reebok International Ltd., Stoughton, Mass.; V2-Jenex Inc., Milford, N.H.

[21] Appl. No.: 733,813

[22] Filed: Oct. 18, 1996

[51] Int. Cl.[6] ..... A63C 17/14

[52] U.S. Cl. ..... 280/11.2; 280/11.22

[58] Field of Search ..... 280/11.2, 11.22

[56] References Cited

U.S. PATENT DOCUMENTS

| | | | |
|---|---|---|---|
| 920,848 | 5/1909 | Eubank, Jr. . | |
| 979,169 | 12/1910 | Kennedy . | |
| 1,402,010 | 1/1922 | Ormiston . | |
| 3,224,785 | 12/1965 | Stevenson . | |
| 4,088,334 | 5/1978 | Johnson . | |
| 4,275,895 | 6/1981 | Edwards . | |
| 4,298,209 | 11/1981 | Peters | 280/11.2 |
| 4,526,389 | 7/1985 | Chase . | |
| 5,088,748 | 2/1992 | Koselka et al. . | |
| 5,118,122 | 6/1992 | Ricart . | |
| 5,183,275 | 2/1993 | Hoskin . | |
| 5,374,070 | 12/1994 | Pellegrini, Jr. et al. . | |
| 5,374,071 | 12/1994 | Johnson . | |
| 5,388,844 | 2/1995 | Pellegrini, Jr. et al. . | |
| 5,397,137 | 3/1995 | Pellegrini, Jr. et al. . | |
| 5,411,276 | 5/1995 | Moldenhauer . | |
| 5,415,419 | 5/1995 | Bourque . | |
| 5,435,579 | 7/1995 | Pozzobon . | |
| 5,435,580 | 7/1995 | Balbinot et al. . | |
| 5,439,238 | 8/1995 | Neal | 280/11.2 |
| 5,462,296 | 10/1995 | Pozzobon . | |
| 5,465,984 | 11/1995 | Pellegrini, Jr. et al. . | |
| 5,470,085 | 11/1995 | Meibock et al. | 280/11.2 |
| 5,484,164 | 1/1996 | McInerney et al. | 280/11.2 |
| 5,486,012 | 1/1996 | Olivieri . | |
| 5,487,552 | 1/1996 | Daoust . | |
| 5,505,468 | 4/1996 | Pozzobon et al. . | |
| 5,505,469 | 4/1996 | Zorzi et al. . | |
| 5,511,804 | 4/1996 | Pellegrini, Jr. et al. . | |
| 5,575,489 | 11/1996 | Oyen et al. | 280/11.22 |
| 5,588,734 | 12/1996 | Talamo et al. | 362/61 |
| 5,590,889 | 1/1997 | Pozzobon . | |
| 5,639,104 | 6/1997 | Haldermann | 280/11.2 |
| 5,649,715 | 7/1997 | Mitchell | 280/11.2 |
| 5,651,556 | 7/1997 | Mitchell | 280/11.2 |
| 5,664,794 | 9/1997 | Mitchell et al. | 280/11.2 |

FOREIGN PATENT DOCUMENTS

| | | | |
|---|---|---|---|
| 585764 | 3/1994 | Italy | 280/11.2 |

OTHER PUBLICATIONS

Strong, Ph.D., "Versatility in Pultrusion," *Composites Fabrication*, Jun. 1996, pp. 9–13.

*Primary Examiner*—Brian L. Johnson
*Assistant Examiner*—Bridget Avery
*Attorney, Agent, or Firm*—Sterne, Kessler, Goldstein & Fox P.L.L.C.

[57] ABSTRACT

A braking system for an in-line skate. The skate includes a boot mounted on a chassis. A cuff is rotatably mounted on the chassis. The chassis has a plurality of wheels rotatably mounted thereon. The braking system for the skate includes a brake pad housing which is either fixedly or pivotally attached to a rear portion of the cuff, a brake pad disposed in the housing, and a roller arm rotatably mounted on the chassis. The roller arm is spring loaded so that when the brake is not in use, the roller arm is disposed above the wheels. The roller arm has a bearing assembly disposed therein, so that when the brake is actuated by a rearward rotation of the cuff, the brake pad engages the bearing assembly of the roller arm, thereby causing said bearing assembly to engage said at least one of the wheels to slow and/or stop the skate.

11 Claims, 4 Drawing Sheets

BRAKING SYSTEM FOR AN IN-LINE SKATE

BACKGROUND OF THE INVENTION

1. Field of the Invention

The present invention relates to a braking system for an in-line skate. In particular, the present invention relates to a cuff-activated brake pad and roller arm assembly for braking a wheel of an in-line skate.

2. Related Art

Many different types of skate brakes have been developed for in-line skates to address the problem of stopping or slowing while skating. The materials used to make conventional skate wheels and bearings have advanced considerably in the past few years. These advancements allow a skater to travel very quickly, up to at least speeds of 15 to 20 mph, using conventional skates.

As the popularity of in-line skating grows, especially in urban areas, the numbers of skaters on streets and paths increase. With this increase in the number of skaters, there is an increased risk of the chance of collisions between skaters and other skaters, bikers, joggers, pedestrians or cars. Thus, there is a need for a skate brake which will allow skaters to slow and/or stop themselves quickly and retain maneuverability while braking to avoid or prevent an accident.

A conventional skate brake consists of a large piece of a rubber brake pad, typically attached to the rear of the skate chassis on at least one skate (left or right) in a pair of skates. In operation, the skater must lift the toe of the skate to which the brake is attached, until the rubber brake pad touches and grabs the skating surface to slow the skater. This conventional skate brake has several drawbacks.

A conventional skate brake is awkward to use, because the skater must pick up the toe of one of the skates and at the same time exert a downward force on the brake pad to slow the skate. It is difficult for a beginner and even an intermediate in-line skater to effectuate braking using this conventional brake while maintaining his balance. The result is that in order to compensate for the awkwardness of the braking position, the skater may not exert as much of a downward force on the brake pad. Thus, it takes a long time to slow the skate or bring the skate to a complete stop. This problem is exacerbated when trying to slow or stop while traveling downhill.

Further, a skater is apt to lose his balance by trying to brake while skating over a bumpy surface, because the skater must lift the toe of the skate to force the brake toward the ground. Thus, one foot of the skater is traveling on only one wheel of the skate, the remaining skate wheels being raised off the ground during braking. Having only one wheel in contact with the ground makes the skate difficult to maneuver particularly on a bumpy or uneven skating surface. Further, the contact between the brake pad and the ground during braking makes it difficult to turn the skate. Thus, during braking using a ground-engaging brake, the skater loses control over maneuverability of the skate, thereby increasing the likelihood of a collision.

Another drawback of the conventional skate brake is that the rubber brake pad is relatively soft compared to most skating surfaces, and thus must be replaced frequently due to excessive wear of the pad from braking.

Another drawback of the conventional skate brake is that it is often difficult for the skater to stop the skate when traveling on a rough or bumpy skating surface, because there is less braking surface for the brake pad to grab to slow the skate. Further, vibrations from the bumpy skating surface will cause the skate to bounce so that the brake pad loses contact momentarily with the ground.

These factors result in less effective braking and a slower response for slowing or stopping the skate using a conventional brake.

Still another drawback of the conventional skate brake is that the amount of downward force exerted by the skater on the brake pad is limited by the skater's body weight, fitness level and the awkwardness of the position that must be maintained to brake. As such, it is difficult for a skater using a conventional skate brake to stop or slow the skate in a short distance. The above-referenced drawbacks of the conventional skate brake result in reaction times of the skater to potential hazards being slowed significantly.

A second type of skate brake is a cuff-activated brake having a rotatable cuff that forces a rubber brake pad against the skating surface. To actuate the brake, the skater moves his foot forward with respect to his other foot. As the skater's foot moves forward, the skater's calf forces the cuff to rotate rearwardly with respect to the skate boot. A rod or other mechanism attached to the cuff is thereby forced toward the ground. A brake pad, disposed on the lower end of the rod, is forced against the ground.

Activation of this type of cuff-activated brake is not as awkward as a conventional brake, because the skater does not have to lift any wheels of the skate off the ground to actuate the brake. Because this type of braking system allows the skater to better maintain his balance while braking, the skater can often exert more downward force on the brake pad, thereby slowing or stopping the skate faster than with a conventional brake. However, the use of a rubber brake pad includes the same drawbacks as discussed above. Namely, the use of a ground-engaging brake pad makes it difficult to brake on bumpy or rough skating surfaces, and the skater loses control over maneuverability of the skate during braking.

Other skates have braking systems that combine a conventional skate brake with a mechanism for simultaneously applying a braking force to one or more of the wheels of the skate. Thus, when the skater tilts the skate to engage the brake pad with the skating surface, the downward force on the brake pad simultaneously activates a second braking mechanism which applies a braking force directly against at least one wheel of the skate. Although this type of braking system applies a second brake directly against the wheel of the skate, the rubber brake pad that contacts the skating surface results in loss of control over maneuverability of the skate. Further, it is difficult to brake on rough or bumpy skating surfaces. Also, the skater must place his body in an awkward position to activate the brake, thereby throwing him off balance and limiting the overall effectiveness of the brake.

Thus, what is needed is a braking system that will effectively apply a sufficient force to a braking member to stop or slow a skate traveling at high speeds in a short distance. Further, what is needed is a braking system that does not require the skater to upset his/her balance and/or center of gravity to actuate the brake. Further, a braking system is needed that provides the skater with controlled maneuverability of the skate while braking.

SUMMARY OF THE INVENTION

The cuff-activated braking system of the present invention provides a braking system that overcomes many of the drawbacks of conventional skate brakes. The skater using the braking system of the present invention can easily actuate the brake to slow or stop the skate quickly and effectively, while maintaining controlled maneuverability of the skate. Thus, response time for the skater is significantly increased because the skater has more control over the speed of the skates during use, and the skater may also easily avoid potential hazards while braking by maneuvering the skate to avoid a collision.

The skate of the present invention includes a skate boot attached to a chassis. The chassis has a plurality of wheels disposed on its lower surface. The braking system of the present invention includes a cuff-activated braking assembly, and a roller arm assembly. The braking assembly is attached to the cuff of the skate and includes a brake pad disposed within a housing. The brake pad is vertically adjustable in the housing to adjust the sensitivity of the braking system.

The roller arm assembly is pivotally spring-mounted to the chassis and includes a roller arm and a bearing assembly. The spring of the roller arm assembly maintains the roller arm in an uppermost position relative to the chassis during normal skating. When the skater wishes to slow or stop the skate, he rotates the pivotally-mounted cuff portion rearwardly, so that the cuff forces the braking assembly downwardly. The brake pad of the braking assembly engages the bearing assembly of the roller arm and forces it downwardly toward the rear wheel of the skate. Thus, the brake pad frictionally engages and slows rotation of the bearing assembly, which, in turn, engages and slows the rear wheel, thereby slowing the skate. Because, in theory, there is no sliding in the wheel/bearing assembly interface, there is no appreciable wheel wear due to the bearing assembly.

In another aspect of the invention, the brake pad housing is pivotally mounted on the cuff, and the braking assembly further includes a linkage member. The linkage member is pivotally attached on one end to the chassis and is pivotally attached on the other end to the brake pad housing. This configuration accommodates braking for different sizes of skate wheels by isolating the rotation of the housing from the rotation of the cuff. Thus, the brake pad is accurately positioned for full engagement with the bearing assembly during braking.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

A preferred embodiment of the present invention is now described with reference to the figures where like reference numbers indicate identical or functionally similar elements. Also in the figures, the left most digit of each reference number corresponds to the figure in which the reference number is first used. Further, although only one skate in a pair of skates is shown in the figures, the left and right skates are mirror images of each other, except that typically only one of the two skates has a brake attached thereto. While specific configurations and arrangements are discussed, it should be understood that this is done for illustrative purposes only. A person skilled in the relevant art will recognize that other configurations and arrangements can be used without departing from the spirit and scope of the invention.

Figure 1:
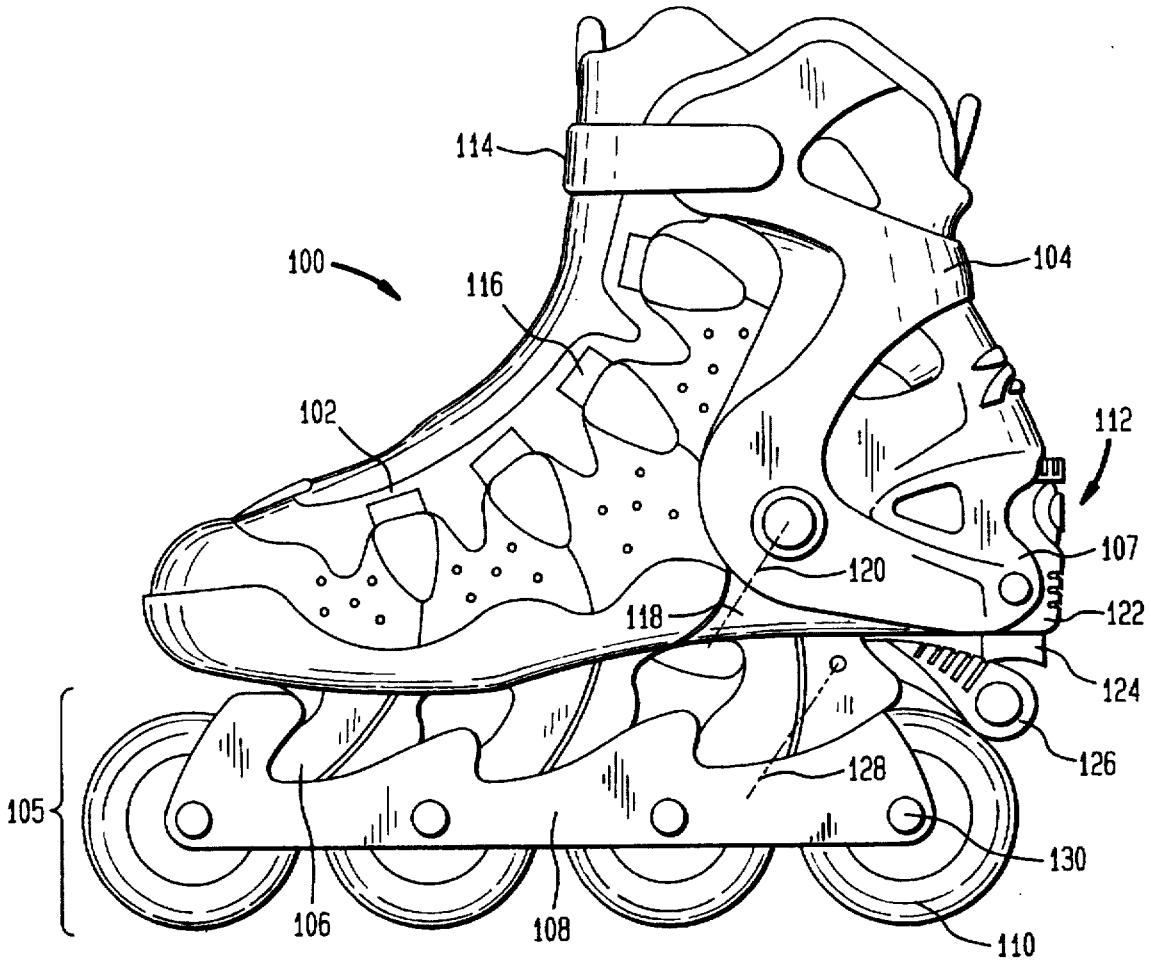
FIG. 1 shows a side view of a skate with a braking system of the present invention.

FIG. 1 shows a skate 100 having a boot 102 and a cuff 104. Boot 102 may be made from a soft material, such as nylon or leather, or may be injection molded from a plastic material or made using other processes apparent to one skilled in the relevant art. Cuff 104 can be injection molded from a plastic material or thermoformed from a composite. Skate 100 also includes a chassis 105, consisting of a transition mount 106 and a frame member 108. In one embodiment, frame member 108 is made by pultrusion.

Pultrusion is a process for making composite parts having a nearly constant cross-section on a continuous basis. In the pultrusion process, fibers, including fiber mats or cloths, are joined to form a fiber bundle which is soaked in a resin bath until it is completely wetted. Excess resin is then removed from the wetted fiber bundle, and the bundle is directed into a heated die. The part is then shaped and cured in the die. The die interior dimensions gradually reduce in size until the final shape is achieved. During this shaping, the part is cured by either thermally heating the die or by subjecting the material to radio frequency (rf) radiation. A puller system, either a series of part-shaped grippers or double continuous belts or caterpillar pullers, pull the part through the die. Part cut-off and packaging is completed after the puller. This process is described in further detail in an article by A. Brent Strong, Ph.D., entitled "Versatility in Pultrusion," *Composites Fabrication*, June, 1996, pp. 9–13, the disclosure of which is incorporated herein by reference.

Figure 5:
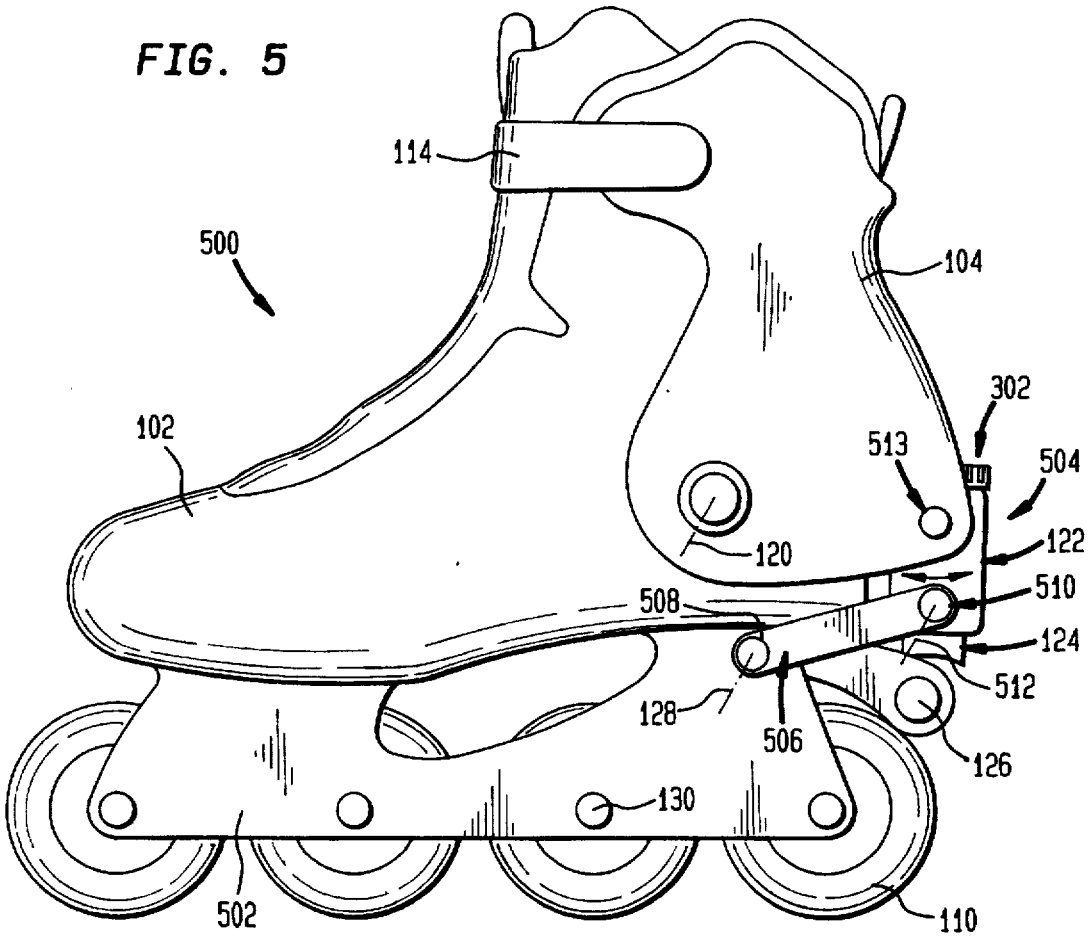
FIG. 5 shows an alternate embodiment of a braking system of the present invention.

Transition mount 106 has a channel 109 to receive frame member 108. Thus, transition mount 106 is used to accommodate pultruded frame member 108 and to provide a raised footbed for the skater. In another embodiment, frame member 108 and transition mount 106 could be injection molded from a single piece of material to form a unitary chassis 105, as shown in FIG. 5. Similarly, it would be apparent to one skilled in the relevant art to mold boot 102 and chassis 105 as one injection molded piece to form a unitary member.

Boot 102 may be rigidly attached to transition mount 106 by gluing, screwing or by other fastening means apparent to one skilled in the relevant art. In one embodiment, transition mount 106 is made by injection-molding. However, it would be apparent to one skilled in the relevant art that transition mount 106 could also be made by extrusion, die casting, machining or other known manufacturing techniques.

Frame member 108 has a plurality of wheels 110 rotatably mounted thereon. Although wheels 110 are shown in FIG. 1 as being aligned, it would be apparent to one skilled in the relevant art that other wheel configurations could also be used. In one embodiment, frame member 108 is made from extruded aluminum. However, it would be apparent to one skilled in the relevant art that frame member 108 could also be made by pultrusion, injection molding, die casting, machining or other known manufacturing techniques.

Wheels 110 are rotatably mounted on axles 130 which are mounted on frame member 108. Wheels 110 may be conventional and include a bearing and spacer arrangement (not shown).

Skate 100 further includes a cuff strap 114 which is used to securely attach the upper portion of boot 102 and cuff 104 around the wearer's ankle. Boot 102 also has loops 116 for inserting a lace (not shown) therein. However, boot 102 could also use a series of buckles to secure the boot to the wearer's foot, or use any other closure system apparent to one skilled in the relevant art.

Transition mount 106 has flanges 118 extending upwardly from the medial and lateral sides thereof. Cuff 104 is rotatably mounted on flanges 118 of transition mount 106. Cuff 104 rotates about rotary axis 120. A braking system 112 consisting of a braking assembly 300 and a roller arm assembly 400 (described in further detail with respect to FIGS. 3 and 4, respectively) is disposed on the rear of skate 100. In particular, braking assembly 300 is mounted on flanges 107 of cuff 104. Braking system 112 includes housing 122 with a brake pad 124 disposed therein and a roller arm 126 rotatably mounted on transition mount 106. Roller arm 126 is mounted on transition mount 106 about a rotary axis 128 and can be injection molded from a piece of plastic material, machined or made using other processes that would be apparent to one skilled in the relevant art.

In operation, a skater moves skate 100, having a brake mounted thereon, forwardly with respect to the remaining skate so that the skater's calf causes cuff 104 of skate 100 to rotate rearwardly with respect to boot 102. Rearward rotation of cuff 104 causes housing 122 and brake pad 124 to move downwardly. As brake pad 124 moves downwardly, it engages a bearing assembly 406, thereby forcing roller arm 126 to rotate toward rear wheel 110 of skate 100. Bearing assembly 406 (described in detail with respect to FIG. 4) of roller arm 126 engages rear wheel 110, thereby slowing skate 100.

Figure 2:
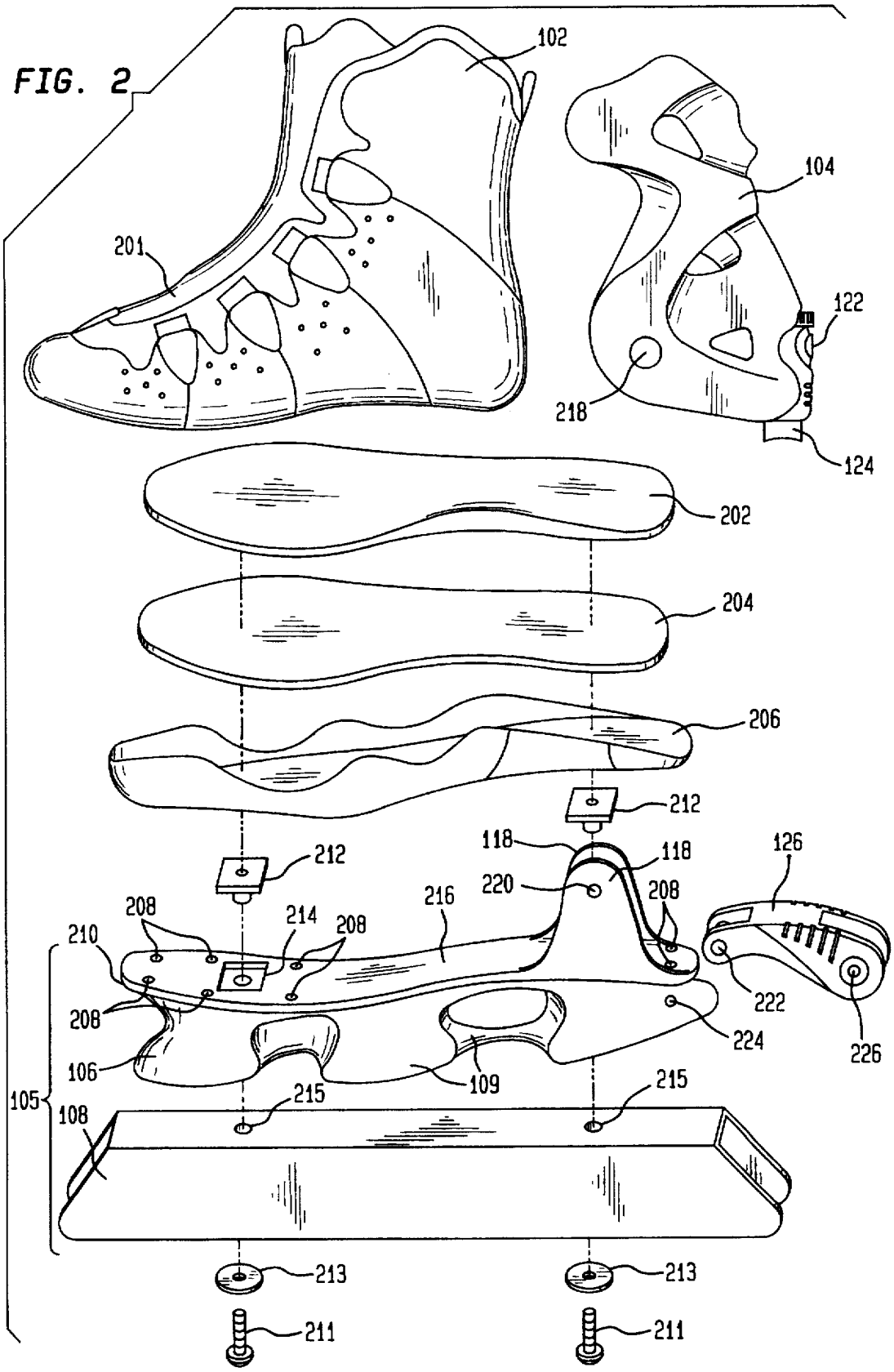
FIG. 2 shows an exploded perspective view of the skate of the present invention.

FIG. 2 shows an exploded view of skate 100 of the present invention. As shown in FIG. 2, boot 102 includes an upper 201, a sockliner 202, a lasting board 204 disposed below sockliner 202 and a rubber outsole 206 disposed below lasting board 204. Upper 201 is attached to transition mount 106 via rivets (not shown) which pass through holes 208 in transition mount 106 from a lower surface 210 thereof and pass through rubber outsole 206 and lasting board 204. The rivets are then peened over to anchor the assembly together. The edges of upper 201 are folded under lasting board 204 and cemented thereto according to conventional shoemaking techniques. The upper surface of rubber outsole 206 is also cemented to upper 201. The lower surface of rubber outsole 206 further includes a recessed cavity (not shown) to receive transition mount 106.

Frame member 108 is mounted to transition mount 106 by two bolts 211 passing through washers 213 and through holes 215 in frame member 108 from the bottom thereof and into two special square nuts 212. Nuts 212 fit within matching square recesses 214 on a top surface 216 of transition mount 106.

Cuff 104 is attached to flanges 118 of transition mount 106. Holes 218 on the medial and lateral sides of cuff 104 are aligned with holes 220 on flanges 118 of transition mount 106. A rivet, screw, or nut and bolt assembly (not shown) can be inserted into aligned holes 218 and 220 to pivotally attach cuff 104 to flanges 118. Similarly, a first set of holes 222 in roller arm 126 are aligned with holes 224 on the medial and lateral sides of transition mount 106. A rivet, screw, or nut and bolt assembly can be inserted through aligned holes 222 and 224 to pivotally attach roller arm 126 to transition mount 106. As shown in FIG. 2, roller arm 126 also has a second set of holes 226 formed therein for mounting a bearing assembly (shown in FIG. 4) therebetween.

Figure 3:
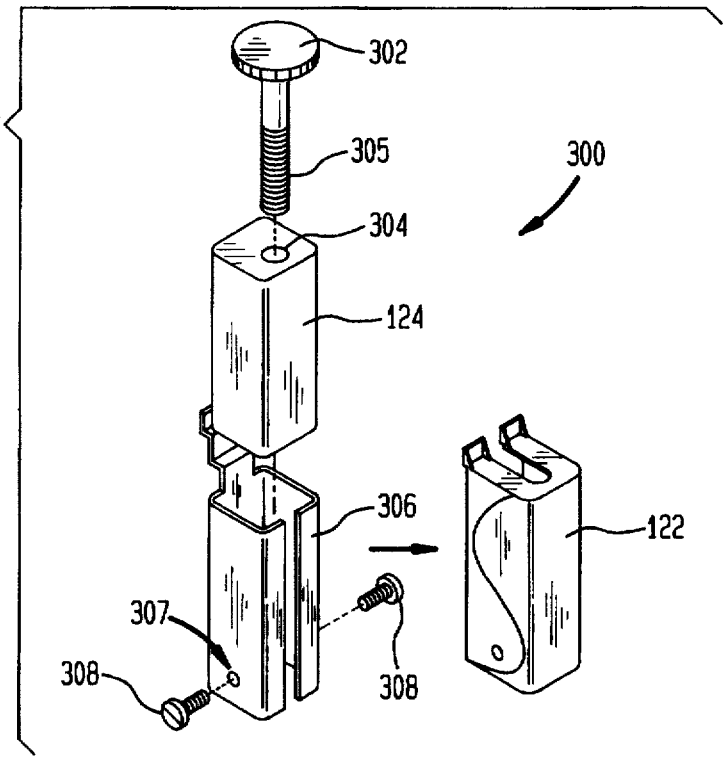
FIG. 3 shows an exploded perspective view of a braking assembly of the present invention.

FIG. 3 shows an exploded view of braking assembly 300 of the present invention. Braking assembly 300 includes an adjuster knob 302, brake pad 124, a bracket 306 and a housing 122. Brake pad 124 is inserted into bracket 306. In one embodiment, bracket 306 is made from stamped steel. Further, brake pad 124 is made from a hard material and has a concave shape at its lower end to engage the bearing assembly of roller arm 126. In one embodiment, brake pad 124 is made from a hard rubber material. Brake pad 124 could also be made from other materials such as, ceramic, plastic, asbestos, or other materials commonly used for brake pad shoes. Brake pad 124 includes a threaded insert 304 disposed in the top of the pad.

Adjuster knob 302 has a threaded end 305 which is screwed into threaded insert 304 of brake pad 124. Adjuster knob 302 may be rotated to adjust the height of brake pad 124 relative to stamped steel bracket 306, thereby adjusting the sensitivity of the braking system. Housing 122 is placed over bracket 306 and screws 308 pass through holes in flanges 107 of cuff 104 and thread into threaded holes 307 in bracket 306, to attach braking assembly 300 to cuff 104. In one embodiment, housing 122 is injection molded.

Figure 4:
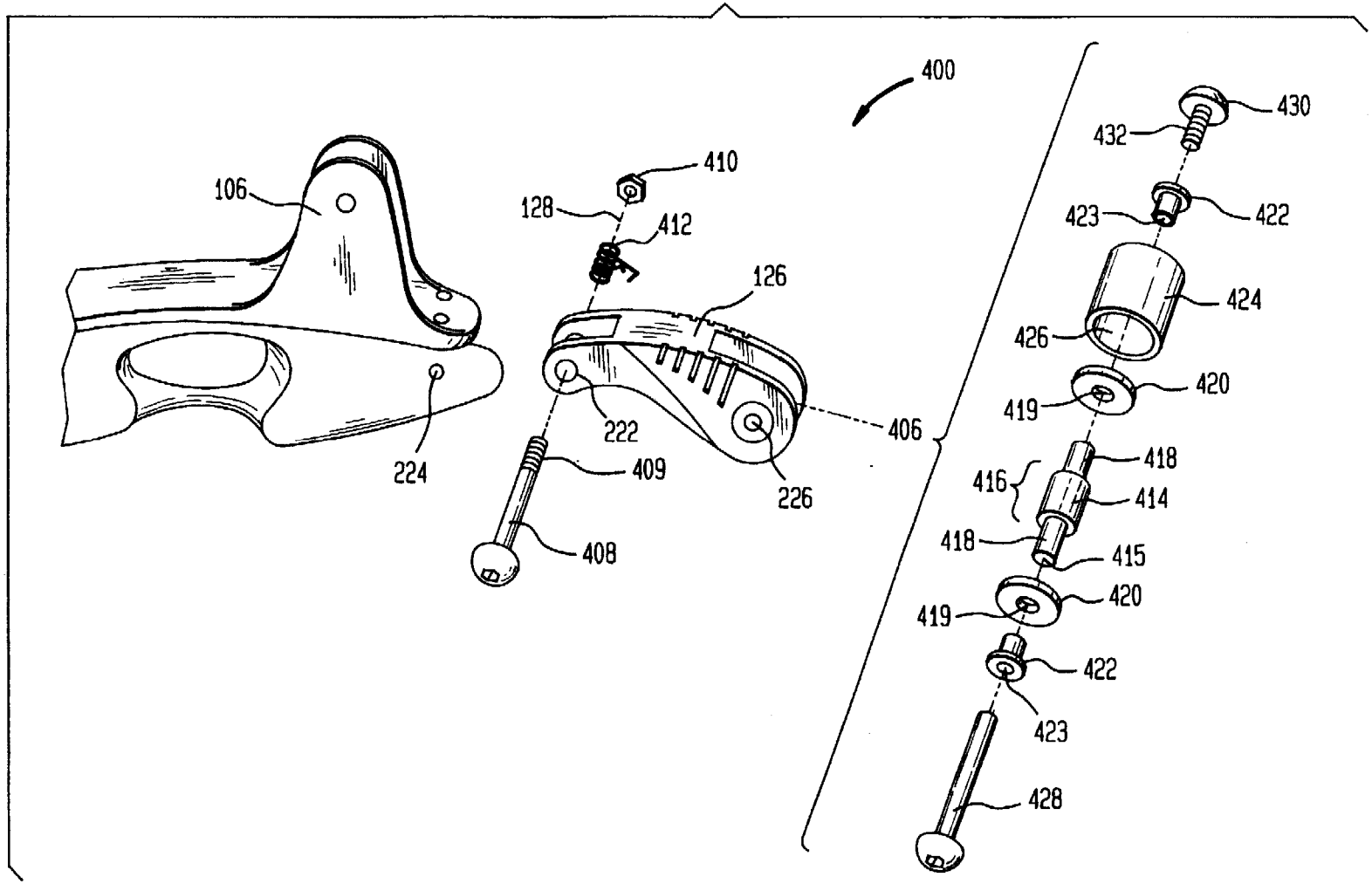
FIG. 4 shows an exploded perspective view of a roller arm assembly of the present invention.

FIG. 4 shows an exploded view of a roller arm assembly 400. Roller arm 126 includes first set of holes 222 and second set of holes 226. First set of holes 222 are used to attach roller arm 126 to transition mount 106. Roller arm 126 is connected to transition mount 106 via an axle 408 and a lock nut 410. Axle 408 is inserted through first set of holes 224 of transition mount 106 and through corresponding holes 222 in roller arm 126. Axle 408 has a threaded end 409, so that lock nut 410 can be screwed on the end of axle 408 to retain axle 408 in roller arm 126. This attachment assembly allows roller arm 126 to be pivotally mounted to transition mount 106 so that it rotates about rotary axis 128.

As shown in FIG. 4, a coil spring 412 is disposed on axle 408 between forked portion of roller arm 126. Coil spring 412 spring loads roller arm 126 so that bearing assembly 406 does not contact rear wheel 110 during normal use of the skate. Thus, only when the skater rotates cuff 104 rearwardly, thereby causing brake pad 124 to overcome the force of coil spring 412, does bearing assembly 406 engage rear wheel 110 of the skate.

A bearing assembly 406 is disposed between second set of holes 226 of roller arm 126. During operation of the brake, bearing assembly 406 comes into contact with a wheel of the skate to slow the wheel. In the preferred embodiment, bearing assembly 406 engages the rear wheel of the skate.

Bearing assembly 406 includes a spacer 414 having a hole 415 formed therethrough. Spacer 414 is disposed between second set of holes 226 of roller arm 126. Spacer 414 has a cuff portion 416 and two arm portions 418 on either side of cuff portion 416. The diameter of cuff portion 416 is larger than arm portions 418. Two bearings 420, having holes 419 formed therein, are rotatably mounted on arm portions 418 of spacer 414. The diameter of holes 419 is smaller than the diameter of cuff portion 416 so that bearings 420 remain spaced apart by cuff portion 416. Two bushings 422, each having holes 423 formed therein, are inserted into holes 419 of bearings 420 to prevent the sides of bearings 420 from coming into contact with the inner sides of roller arm 126. A sleeve 424 is then slid over bearing assembly 406, so that bearings 420 are disposed within an inner surface 426 of sleeve 424. The fit between bearings 420 and sleeve 424 is such that bearings 420 cannot rotate relative to sleeve 424. In the preferred embodiment, sleeve 424 is made of hardened steel.

Bearing assembly 406 is placed between second set of holes 226 of roller arm 126 so that holes 415, 419 and 423 in the components of bearing assembly 406 align with second set of holes 226. Bearing assembly 406 is rotatably mounted between second set of holes 226 via an axle 428 that is inserted through the aligned holes of roller arm 126 and bearing assembly 406. Axle 428 has a threaded inner surface on one end (not shown). A bolt 430, having a threaded end 432, is inserted into the threaded end of axle 428 to prevent axle 428 from disengaging from bearing assembly 406.

In operation, brake pad 124 frictionally engages sleeve 424 of bearing assembly 406. Further, the downward force of brake pad 124 causes roller arm 126 to rotate about rotary axis 128 so that sleeve 424 engage rear wheel 110 of skate 100. As sleeve 424 is pressed between brake pad 124 and wheel 110, brake pad 124 slows rotation of sleeve 424. Because there is no sliding between sleeve 424 and wheel 110, the slowed rotation of sleeve 424, in turn, slows wheel 110.

FIG. 5 shows an alternate embodiment of a skate 500 of the present invention. Skate 500 includes boot 102 and cuff 104, as described with respect to FIG. 1. Skate 500 also includes a chassis 502 which is made from a unitary piece of material.

Skate 500 is assembled as shown in FIG. 2. Chassis 502 has a plurality of wheels 110 rotatably mounted thereon. Wheels 110 are rotatably mounted on axles 130 which are mounted on chassis 502. In one embodiment, chassis 502 is made from injection-molded plastic. However, it would be apparent to one skilled in the relevant art that chassis 502 could also be made by die casting, machining or other known manufacturing techniques.

In this embodiment, cuff 104 is rotatably mounted to rigid supports (not shown) within the lateral and medial sides of boot 102. Cuff 104 rotates about rotary axis 120. A braking system 504 consisting of braking assembly 300 and roller arm assembly 400 is disposed on the rear of skate 500. Braking system 504 includes housing 122 which is rotatably mounted on cuff 104 at pivot point 513. Housing 122 includes a brake pad 124 disposed therein. Roller arm 126 is rotatably mounted on chassis 502 about rotary axis 128.

Braking system 504 further includes a linkage member 506 which is pivotally mounted at a first end 508 on chassis 502 about rotary axis 128. Linkage member 506 is pivotally mounted at a second end 510 on housing 122 about a rotary axis 512. Thus, first end 508 of linkage member 506 and roller arm 126 rotate about the same rotary axis 128 at the same pivot point. This configuration allows housing 122 and roller arm 126 to follow the same arc during rotation relative to each other so that brake pad 124 is accurately positioned for full engagement with bearing assembly 406 during braking. Thus, rotation of housing 122 is isolated from the rotation of cuff 104.

In operation, a skater moves skate 500, having a brake mounted thereon, forwardly with respect to the remaining skate so that the skater's calf causes cuff 104 of skate 500 to rotate rearwardly with respect to boot 102. Rearward rotation of cuff 104 causes housing 122 and brake pad 124 to move downwardly. As brake pad 124 moves downwardly, it engages bearing assembly 406, thereby forcing roller arm 126 to rotate toward rear wheel 110 of skate 500. Rotation of roller arm 126 coincides with rotation of linkage member 506. Rotation of linkage member 506 causes housing 122 to pivot about rotary axis 512. Rotation of housing 122 causes brake pad 124 to be accurately positioned to engage bearing assembly 406 of roller arm 126. Bearing assembly 406 then engages rear wheel 110, thereby slowing skate 100.

While the invention has been particularly shown and described with reference to preferred embodiments thereof, it will be understood by those skilled in the art that various changes in form and details may be made therein without departing from the spirit and scope of the invention.

What is claimed is:

1. An in-line skate, comprising:

a boot;

a chassis having an upper surface and a lower surface, wherein said boot is disposed about said upper surface of said chassis;

a plurality of wheels disposed on said lower surface of said chassis;

a cuff rotatably disposed about a first pivot axis, said first pivot axis at a pivot point near a skater's malleolus; and a braking system, including, a housing attached to a rear portion of said cuff, a brake pad disposed in said housing, and a roller arm rotatably mounted on said chassis about a second pivot axis such that said roller arm, in a resting position, is disposed proximate at least one of said plurality of wheels, said roller arm having a bearing assembly disposed therein, wherein rotation of said cuff causes said brake pad to engage said bearing assembly, thereby causing said bearing assembly to engage said at least one of said plurality of wheels.

2. The in-line skate of claim 1, wherein said chassis comprises a frame member for housing said plurality of wheels and a transition mount disposed between said frame member and said boot.

3. The in-line skate of claim 2, wherein said transition mount includes flanges, said cuff being pivotally mounted on said flanges of said transition mount.

4. The in-line skate of claim 1, wherein said braking system further comprises a bracket, said brake pad being disposed in said bracket, and wherein said bracket is disposed within said housing.

5. The in-line skate of claim 1, wherein said braking system further comprises an adjuster knob, rotatably disposed in said brake pad, for adjusting the vertical position of said brake pad within said housing.

6. The in-line skate of claim 1, wherein said roller arm is spring-mounted on said chassis, so that it returns to its uppermost position after braking occurs.

7. The in-line skate of claim 1, wherein said brake pad has a lower end, said lower end being concave to mate with said bearing assembly.

8. An in-line skate, comprising:

a boot;

a chassis having an upper surface and a lower surface, wherein said boot is disposed about said upper surface of said chassis;

a plurality of wheels disposed about said lower surface of said chassis;

a cuff rotatably disposed about a first pivot axis, said first pivot axis at a pivot point near a skater's malleolus; and a braking system, including, a housing pivotally attached at an upper end to a rear portion of said cuff, a brake pad disposed in said housing, a roller arm rotatably mounted on said chassis about a second pivot axis such that said roller arm, in a resting position, is disposed proximate at least one of said plurality of wheels, said roller arm having a bearing assembly disposed therein, and a linkage member having a first end and a second end, said first end of said linkage member being pivotally attached to said chassis about said second pivot axis, and said second end of said linkage member being pivotally attached to said housing, wherein rotation of said cuff causes said brake pad to engage said bearing assembly, thereby causing said roller arm and said linkage member to pivot about said second pivot axis and said bearing assembly to engage said at least one of said plurality of wheels.

9. The in-line skate of claim 8, wherein said braking system further comprises a bracket, said brake pad being disposed in said bracket, and wherein said bracket is disposed within said housing.

10. The in-line skate of claim 8, wherein said braking system further comprises an adjuster knob, rotatably disposed in said brake pad, for adjusting the vertical position of said brake pad within said housing.

11. The in-line skate of claim 8, wherein said roller arm is spring-mounted on said chassis, so that it returns to its uppermost position after braking occurs.

* * * * *